US005813199A

United States Patent [19]

Temburg

[11] Patent Number: 5,813,199

[45] Date of Patent: Sep. 29, 1998

[54] METHOD AND APPARATUS FOR SEVERING FIBER BALE TIES

[75] Inventor: Josef Temburg, Jüchen, Germany

[73] Assignee: Trützschler GmbH & Co. KG, Mönchengladbach, Germany

[21] Appl. No.: 660,008

[22] Filed: Jun. 3, 1996

[30] Foreign Application Priority Data

Jun. 2, 1995 [DE] Germany ..... 195 20 248.1

[51] Int. Cl.[6] ..... B65B 43/26

[52] U.S. Cl. ..... 53/492; 53/504; 53/381.1; 53/381.2; 53/381.4; 414/412; 414/414

[58] Field of Search ..... 53/492, 504, 381.2, 53/381.4, 381.1; 414/412, 414; 83/909, 358, 370

[56] References Cited

U.S. PATENT DOCUMENTS

| | | | |
|---|---|---|---|
| 2,820,282 | 1/1958 | Schneider, Jr. | 53/381.2 |
| 4,878,287 | 11/1989 | Hergeth | 83/370 |
| 4,929,141 | 5/1990 | Keesey et al. | 53/381.2 |
| 5,101,703 | 4/1992 | Tanaka et al. | 53/492 |
| 5,375,316 | 12/1994 | Carlson et al. | 83/909 |
| 5,400,493 | 3/1995 | Hall | 83/909 |
| 5,406,690 | 4/1995 | Nielsen et al. | 83/909 |
| 5,425,219 | 6/1995 | Tanaka et al. | 53/381.2 |
| 5,475,967 | 12/1995 | Levi | 53/381.2 |

FOREIGN PATENT DOCUMENTS

| | | | |
|---|---|---|---|
| 0 639 663 | 2/1995 | European Pat. Off. . | |
| 2348768 | 6/1974 | Germany | 53/504 |
| 35 45 659 | 6/1987 | Germany . | |
| 89 14 075 | 5/1990 | Germany . | |
| 2 183 194 | 6/1987 | United Kingdom . | |
| 2 242 851 | 10/1991 | United Kingdom . | |
| 2 249 076 | 4/1992 | United Kingdom . | |
| 93/18973 | 9/1993 | WIPO . | |

*Primary Examiner*—James F. Coan
*Assistant Examiner*—Gene L. Kim
*Attorney, Agent, or Firm*—Spencer & Frank

[57] ABSTRACT

An apparatus for severing a fiber bale tie surrounding a fiber bale includes a bale advancing device for moving the fiber bale in an advancing direction along a travel path; a tie cutter for severing the tie; a bale position determining device for emitting a signal when the bale has reached a predetermined location along the travel path; and a device for moving the tie cutter transversely to the conveying direction from a remote position spaced from the bale into engagement with a bale surface when the bale has reached the predetermined location to effect severance of the tie as relative movement between the bale and said tie cutter takes place.

15 Claims, 5 Drawing Sheets

METHOD AND APPARATUS FOR SEVERING FIBER BALE TIES

CROSS REFERENCE TO RELATED APPLICATION

This application claims the priority of German Application No. 195 20 248.1 filed Jun. 2, 1995, which is incorporated herein by reference.

BACKGROUND OF THE INVENTION

This invention relates to a method and an apparatus for severing ties made, for example, of wire, straps and the like and/or wrapper material for textile fiber bales, particularly cotton fiber bales or artificial fiber bales. The fiber bales and a tie and/or wrapper cutter and the fiber bales are moved relatively to one another and the cutter severs the tie and/or the wrapper. The fiber bales are moved through the region of the cutter on a conveyor device such as a conveyor belt, a roller track, a carriage or the like, while the cutter is stationarily supported during severance.

In a known process the fiber bale is in a free-standing state during the severing process. Prior to processing of the fiber bale the ties have to be cut and removed therefrom.

SUMMARY OF THE INVENTION

It is an object of the invention to provide an improved method and apparatus of the above-outlined type which makes possible a secure severance of the bale ties.

This object and others to become apparent as the specification progresses, are accomplished by the invention, according to which, briefly stated, the apparatus for severing a fiber bale tie surrounding a fiber bale includes a bale advancing device for moving the fiber bale in an advancing direction along a travel path; a tie cutter for severing the tie; a bale position determining device for emitting a signal when the bale has reached a predetermined location along the travel path; and a device for moving the tie cutter transversely to the conveying direction from a remote position spaced from the bale into engagement with a bale surface when the bale has reached the predetermined location to effect severance of the tie as relative movement between the bale and said tie cutter takes place. After the severing step the tie cutter is moved away from the bale towards the remote position.

By moving the cutter up to the fiber bale before the severing process and moving the cutter away from the bale after the severing process, an adaptation to the actual width of the fiber bale is possible so that the severing operation allows a reliable cutting of the bale ties. By moving the pressing element, the fiber bale is accurately positioned for engagement with the cutter, independently from the bale width. Further, the flat pressing element, together with the counterface, forms a guide trough so that the fiber bale is advantageously guided and laterally supported to ensure that a secure engagement by the cutter with all the bale ties is achieved during the severing process.

DESCRIPTION OF THE PREFERRED EMBODIMENT

Figure 1:
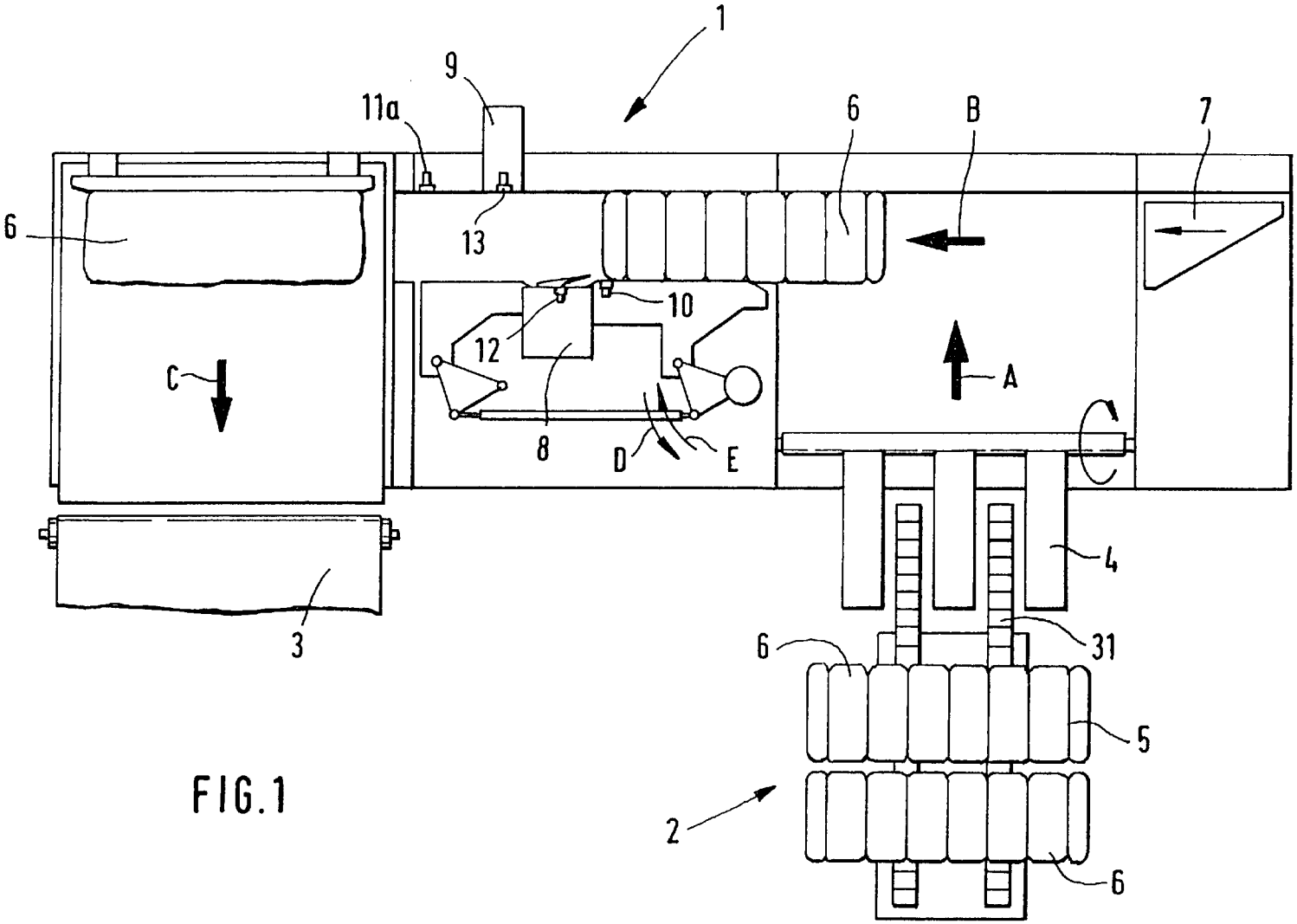
FIG. 1 is a schematic top plan view of the apparatus according to the invention, situated between a bale supplying device and a bale removing device.

Turning to FIG. 1, the apparatus according to the invention is positioned between a bale supplying apparatus 2 and a bale removing apparatus 3. The bale supplying apparatus 2 includes a chain conveyor 31 and a bale hoisting pivotal fork 4 supported in a rotary bearing. The bale ties 5 usually consist of narrow steel bands or wires. Prior to processing the fiber bale 6, for example, by means of a non-illustrated bale opener, the ties 5 which circle the highly-compressed fiber bale, have to be removed. For this purpose, the bale 6 is admitted in the direction A to a bale preparing apparatus 1 and is moved by a pusher element 7 in the direction B against a tie cutter 8 and is also moved past a tie removing device 9 for removing the severed ties 5 from the fiber bale. Thereafter the bale 6 is advanced in the direction C and is admitted to the bale removing apparatus 3 which may be an endless conveyor, a bale carriage or the like which transports the bale to a non-illustrated bale opener which may be a BLENDOMAT BDT model, manufactured by Trützschler GmbH & Co. KG, Mönchengladbach, Germany.

Figure 2A:
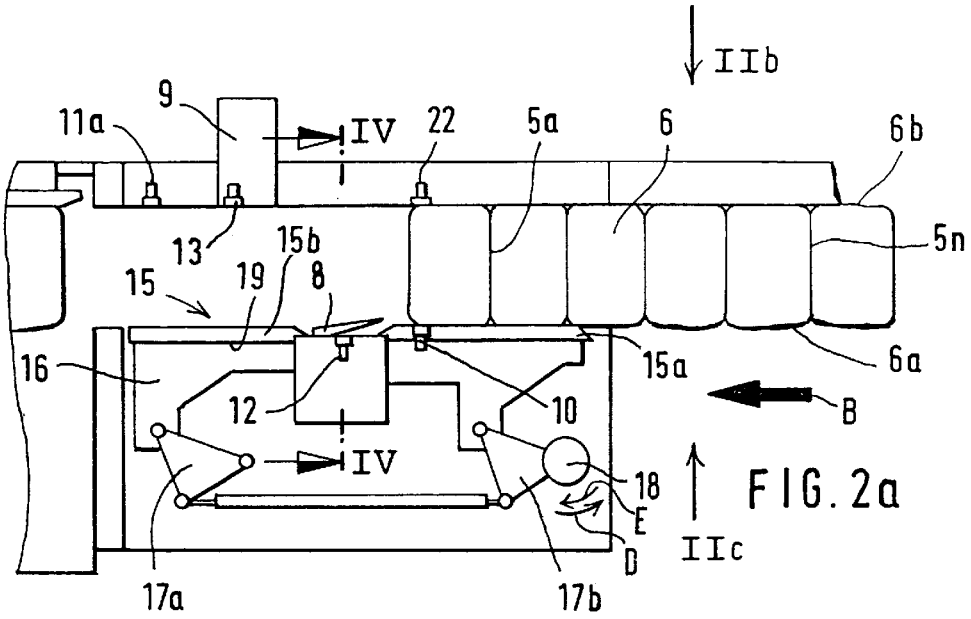
FIG. 2*a* is a schematic top plan view of a part of a preferred embodiment of the invention operating with four metal sensors.
Figure 2B:
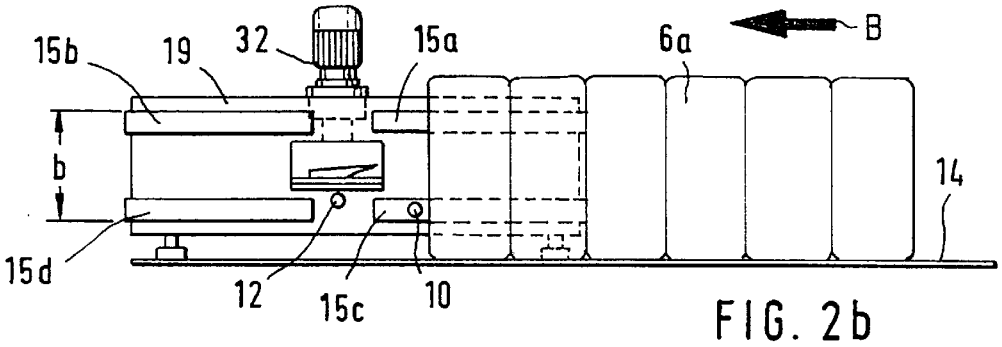
FIG. 2*b* is a schematic side elevational view of the construction shown in FIG. 2*a*, as seen in the direction of the arrow II*b* in FIG. 2*a*.
Figure 2C:
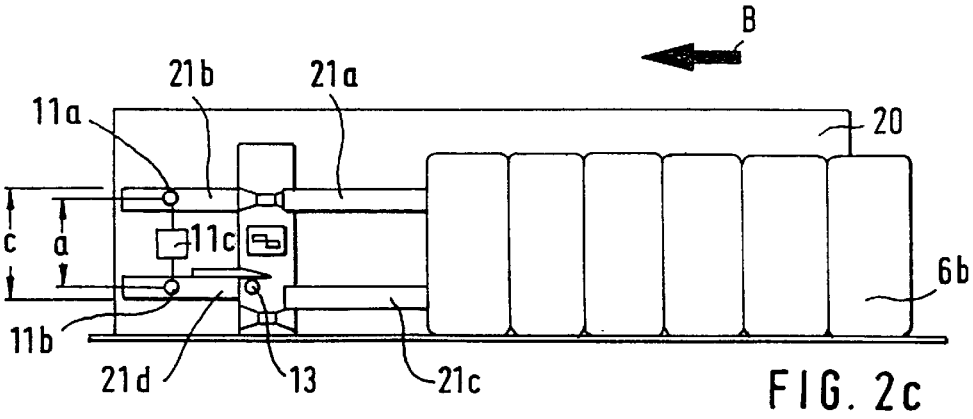
FIG. 2*c* is a schematic side elevational view of the construction shown in FIG. 2*a*, as seen in the direction of the arrow II*c* in FIG. 2*a*.
Figure 5:
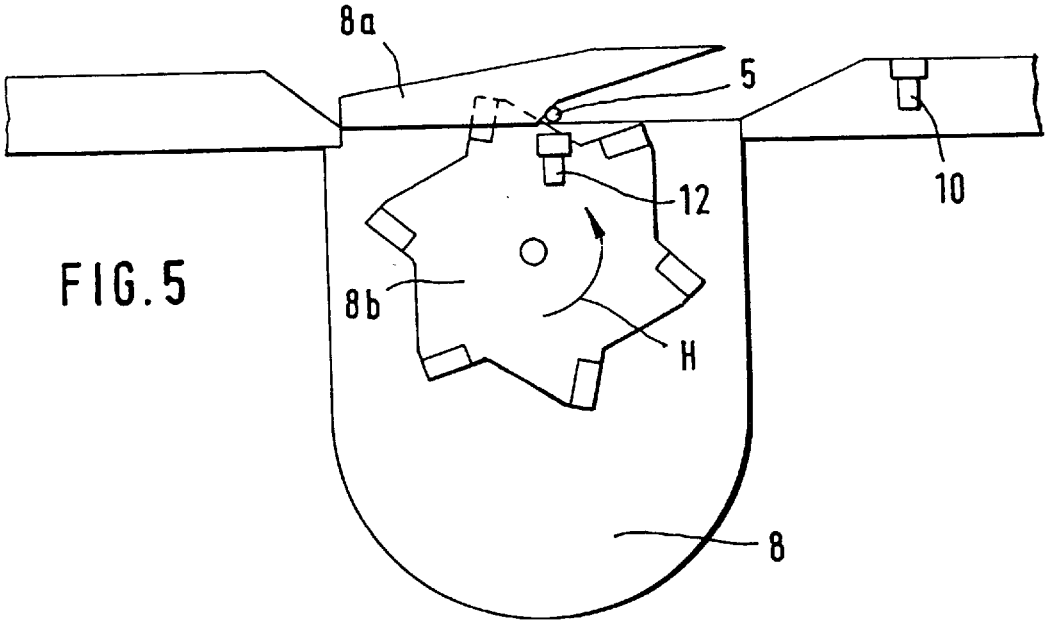
FIG. 5 is a schematic side elevational view of a tie cutter forming part of the apparatus according to the invention.

Also referring to FIGS. 2*a*, 2*b* and 2*c*, an inductive proximity sensor 10, operating as a contactless metal detector, is oriented towards a side face 6*a* of the fiber bale 6. The metal sensor 10 is situated upstream of the tie cutter 8 as viewed in the direction of fiber bale advance and serves for detecting (recognizing) metal bale ties 5*a*–5*n*. Two additional, second inductive proximity sensors 11*a* and 11*b* operating as contactless metal detectors are provided which are oriented towards the side face 6*b* of the fiber bale 6. The two sensors 11*a* and 11*b* are at a vertical distance a from one another and are situated downstream of the tie cutter 8 and the tie removing device 9. The sensors 11*a*, 11*b* serve for detecting those bale ties or tie parts 5*a*–5*n* which were not severed and/or removed by the tie cutter 8 and/or the tie removing device 9. The sensors 11*a*, 11*b* are connected with a signalling device 11*c* to indicate the presence of a tie or tie parts detected by the sensor 11*a* and/or 11*b*. As an alternative, or in addition, the sensors 11*a*, 11*b* are connected to a fiber bale removing device which, when the sensors 11*a* and/or 11*b* detect the presence of a tie or tie parts in the bale, prevents the bale from being admitted to the conveyor 3, and, for example, directs the bale to a location where the residual ties or tie parts are removed. There is further provided a third metal detector 12 which is also an inductive proximity sensor and which is oriented towards the tie cutter 8, as shown in FIG. 5. The sensor 12 determines the presence and position of a bale tie 5*a*–5*n* in the tie cutter 8. Further, a fourth metal detector 13 is provided which is also an inductive proximity sensor 13 and which is associated with the tie removing device 9. The sensor 13 responds to the presence and position of a bale tie 5*a*–5*n* in the tie removing device 9.

The tie cutter 8 and a pressing device generally designated at 15 are, as shown in FIG. 2*a*, mounted on a common holding device 16 which is pivotally held by two levers 17*a*, 17*b* supported for rotation about a stationary rotary bearing 18 driven by a motor 29 for counterclockwise and clockwise pivotal motions as indicated by respective arrows D and E. Thus, the levers 17*a*, 17*b* and the holding device 16 form part of a parallelogram linkage, whereby the holding device 16 is moved parallel to itself. The pressing device 15, as shown in FIG. 2*b*, is formed of four bars 15*a*, 15*b*, 15*c* and 15*d* arranged on a surface 19 of the holding device 16. The bar 15*a* is in a longitudinal alignment with the bar 15*b* and the bar 15*c* is in a longitudinal alignment with the bar 15*d*. Further, the bars 15*a*, 15*b* are parallel to the bars 15*c*, 15*d* and are arranged thereabove at a distance b. The tie removing device 9 is secured on a stationary surface 20 which also supports longitudinally arranged bars 21*a*, 21*b*, 21*c* and 21*d*. The bars 21*a* and 21*b* are positioned above bars 21*c* and 21*d* at a distance c therefrom.

Figure 3A:
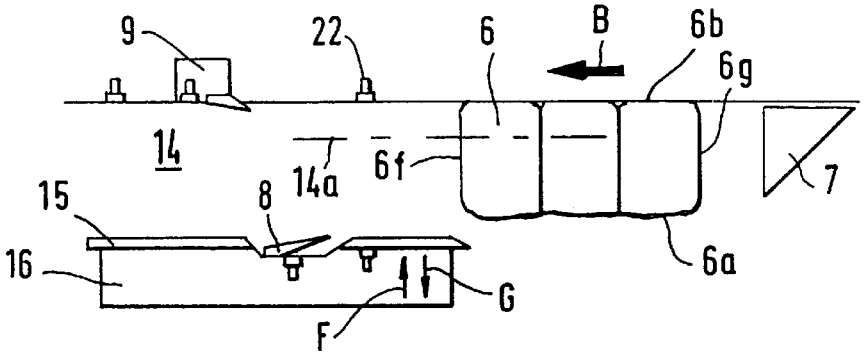
FIGS. 3*a*–3*e* are schematic top plan views of different, subsequent operational phases performed by the apparatus according to the invention.
Figure 3B:
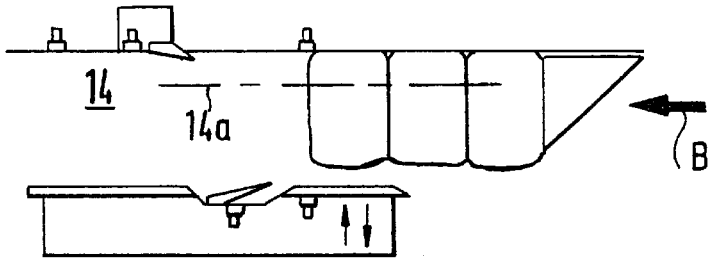
Figure 3C:
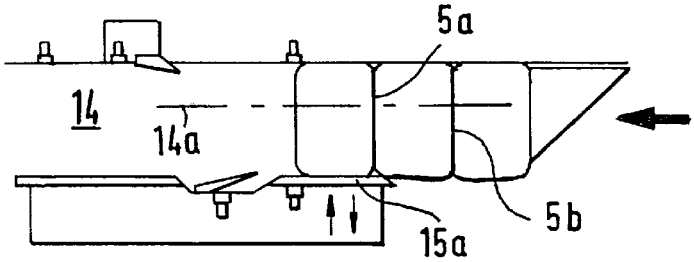
Figure 3D:
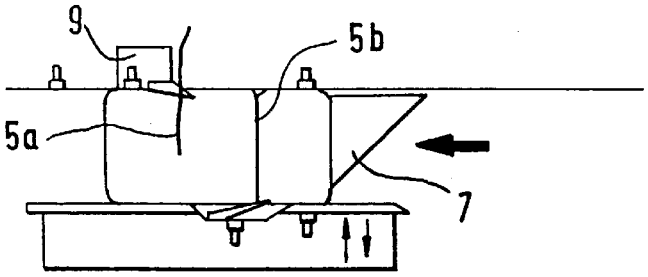
Figure 3E:
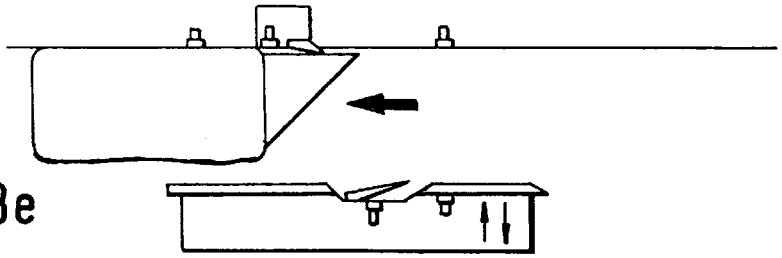

The fiber bale 6 is positioned on a bale supporting surface, such as a smooth slide plate 14. In operation the bale 6 is, as shown in FIG. 3*a*, pushed from its initial position by the driven pusher element 7 in the direction of the arrow B up to an optical barrier 22 into the position as shown in FIG. 3*b*. The optical barrier 22 is situated upstream of the tie cutter 8 as viewed in the direction B. Subsequently, the holding device 16, together with the tie cutter 8 and the pressing device 15 is pivoted in the direction of the arrow F until the bars 15*a* and 15*c* of the holding device 16 firmly engage the side 6*a* of the bale 6, as shown in FIG. 3*c*. The motion of the holding device 16 and the tie cutter 8 is thus toward an imaginary reference plane 14*a* which extends parallel to the bale advancing direction B and perpendicularly intersects the slide plate 14. In this position the bale 6 is firmly pressed by the bars of the pressing device 15 against the bars 21*a*, 21*c* which, together with bars 21*b*, 21*d* act as counter supports. Thus, the opposing wall surfaces 19 and 20 and the slide plate 14 act as a trough surrounding the bale 6 on three sides. Thereafter the fiber bale 6 is pushed in the direction B as shown in FIG. 3*d* by the pusher 7 as the bale ties 5*a*–5*n* are in sequence severed by the tie cutter 8. Thereafter, as shown in FIG. 3*d*, the fiber bale 6 is pushed along the tie removing device 9 which pulls away the severed ties 5*a*–5*n* from the bale 6. Subsequently, the holding device 16 is pivoted back into its position in the direction of the arrow G as shown in FIG. 3*e*.

Figure 4:
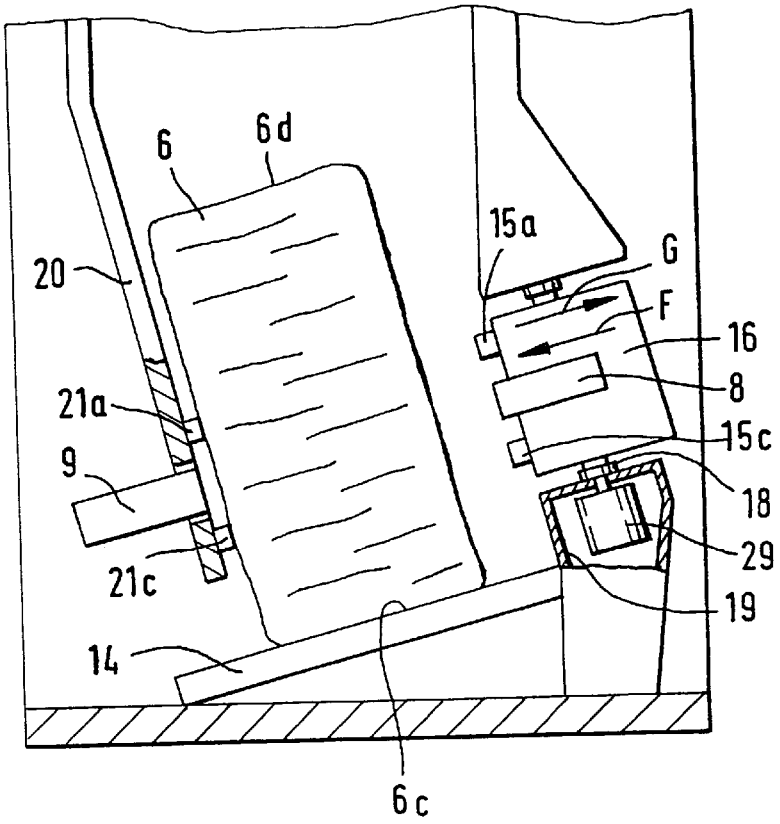
FIG. 4 is a sectional view taken along line IV—IV of FIG. 2*a*.

Turning to FIG. 4, the fiber bale 6 is situated in a slightly oblique orientation and leans against the bars 21*a* and 21*c* carried by the surface 20, while its bottom face 6*c* rests on the slide plate 14. The surfaces 19 and 20 leave openings for the tie cutter 8 and the tie removing device 9. A motor 29 drives the holding element 16 to execute its pivotal motion with the tie cutter 8 and the pressing device 15.

While according to the described preferred embodiment the fiber bale 6 frictionally slides on the bars 15*a*–15*d*, the bars 21*a*–21*d* and the plate 14, it is understood that any or all of these bale-engaging elements may be formed, with appropriate orientation, as rolling components, for example, as rotatably held roller bars to provide a rolling friction with the respective bale face.

As shown in FIG. 5, the tie cutter 8 comprises a spike 8*a* and a star-shaped cutter wheel 8*b* which is slowly rotated in the direction of the arrow H by a motor 32 as shown in FIG. 2*b*. The spike 8*a* is pushed through the side face 6*a* of the fiber bale 6 and underneath the bale tie 5 which is thus lifted off the side face 6*a* and placed between two points of the star-shaped cutter wheel 8*b*. As the cutter wheel 8*b* rotates, the bale tie 5 is severed while it is wedged against the cutter wheel 8*b*. Underneath the cutter wheel 8*b* the sensor 12 is oriented towards the spike 8*a* to determine whether a bale tie 5 is present, while the sensor 10 is situated upstream of the tie cutter 8.

Figure 6:
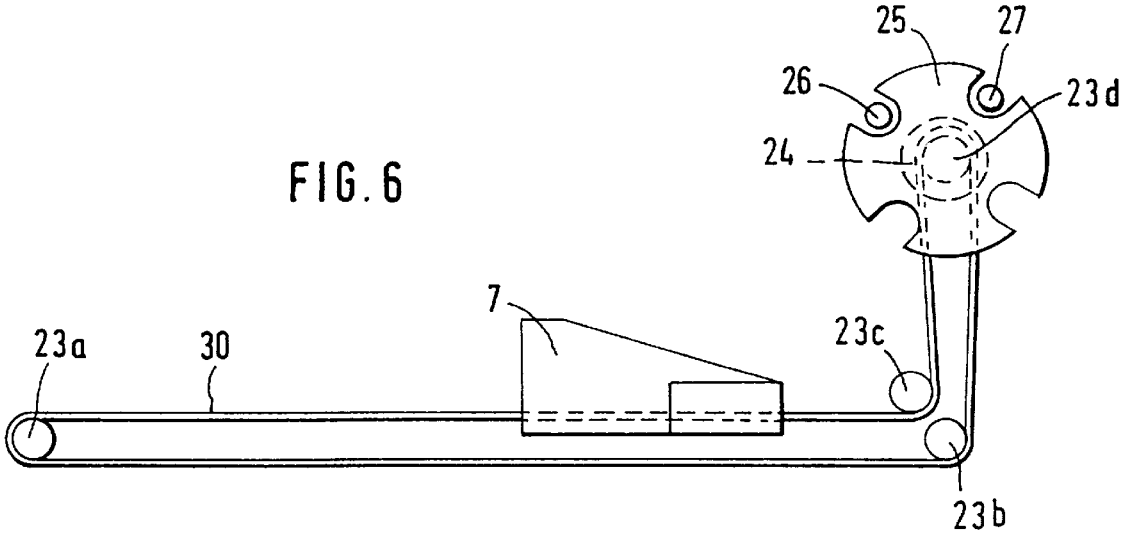
FIG. 6 is a schematic side elevational view of a driving device for a bale shifting element forming part of the apparatus according to the invention.

As shown in FIG. 6, the pusher element 7 is secured to an endless belt or chain 30 which is trained about rollers 23*a*, 23*b*, 23*c* and 23*d*. The roller 23*d* is driven by an electric motor 24 and carries a counting disk 25 associated with two inductive path sensors 26 and 27 for forward and rearward run. The counting device 25, 26, 27 measures the path travelled by the pusher element 7 and emits signals used for controlling a corresponding motion process for the bale 6.

Figure 7:
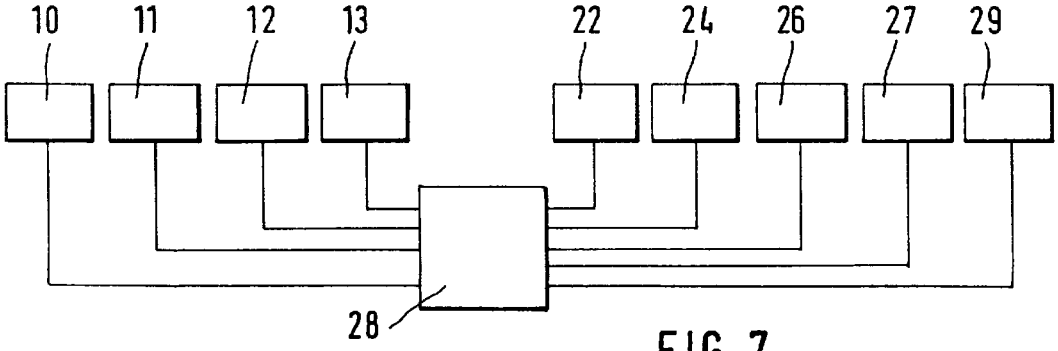
FIG. 7 is a block diagram illustrating the electronic control of the apparatus according to the invention.

As shown in FIG. 7, an electronic control and regulating device 28, for example, a microcomputer is provided to which the first proximity sensor 10, the second proximity sensors 11*a*, 11*b*, the third proximity sensor 12, the fourth proximity sensor 13, the optical barrier 22, the drive motor 24 for the pusher element 7, the drive motor 29 for the holding device 16 as well as the proximity sensors 26 and 27 are attached.

It will be understood that the above description of the present invention is susceptible to various modifications, changes and adaptations, and the same are intended to be comprehended within the meaning and range of equivalents of the appended claims.

What is claimed is:

1. An apparatus for severing a fiber bale tie surrounding a fiber bale, comprising (a) bale advancing means for moving the fiber bale in an advancing direction along a travel path; said bale advancing means comprising a bale supporting surface for engaging a bottom face of the bale;

(b) a tie cutter for severing the tie;

(c) a bale position determining means for emitting a signal when the bale has reached a predetermined location along said travel path; and (d) moving means for moving the tie cutter, transversely to said conveying direction and toward an imaginary reference plane which intersects said bale supporting surface and which is parallel to said conveying direction, from a remote position spaced from the bale into engagement with a side face of the bale and for holding the tie cutter stationarily at said side face when the bale has reached said predetermined location to effect severance of the tie as relative movement between the bale and said tie cutter takes place.

2. The apparatus as defined in claim 1, wherein said bale position determining means comprises an optical barrier situated at said predetermined location.

3. The apparatus as defined in claim 1, wherein said bale advancing means includes a bale-engaging element and a first drive means for moving said bale-engaging element; further wherein said moving means for moving said tie cutter includes a second drive means for the tie cutter; further comprising an electronic control and regulating device connected to said first and second drive means and said bale position determining means.

4. The apparatus as defined in claim 1, further comprising a counter surface for engaging a first side face of the bale and pressing means for engaging a second side face of the bale upon reaching said predetermined location to press the bale against said counter surface.

5. The apparatus as defined in claim 4, wherein said pressing means comprises (a) pressing bars for engaging the second side face of the bale;

(b) a holding device for fixedly supporting said pressing bars; and (c) displacing means for moving the holding device transversely to said conveying direction from a remote position spaced from the bale into a position in which said pressing bars engage the second side face of the bale when the bale has reached said predetermined location to press the bale by said pressing bars against said counter surface.

6. The apparatus as defined in claim 5, wherein said displacing means comprises a parallelogram linkage for displacing said holding device parallel to itself.

7. The apparatus as defined in claim 5, wherein said tie cutter is mounted on said holding device and further wherein said moving means for moving the tie cutter and said displacing means for displacing said holding device forms a unitary structure.

8. The apparatus as defined in claim 7, wherein said bale advancing means includes a bale-engaging element and a first drive means for moving said bale-engaging element; further wherein said unitary structure includes a second drive means for moving said holding device; further comprising an electronic control and regulating device connected to said first and second drive means and said bale position determining means.

9. The apparatus as defined in claim 5, wherein said bale advancing means comprises a pusher element for engaging a rear face of the bale.

10. The apparatus as defined in claim 4, wherein said bale supporting surface is stationary; the stationary surface, said pressing means and said counter surface forming a trough for surrounding the bale on three sides thereof.

11. The apparatus as defined in claim 10, further comprising a stationary slide plate having a face forming said stationary surface for engaging the bottom face of the bale.

12. An apparatus for severing a fiber bale tie surrounding a fiber bale, comprising (a) bale advancing means for moving the fiber bale in an advancing direction along a travel path; said bale advancing means comprising a bale supporting surface for engaging a bottom face of the bale;

(b) a tie cutter for severing the tie;

(c) a bale position determining means for emitting a signal when the bale has reached a predetermined location along said travel path; and (d) moving means for moving the tie cutter, transversely to said conveying direction toward a bale side face oriented parallel to said conveying direction, from a remote position spaced from the bale into engagement with the bale side face and for holding the tie cutter stationarily at said side face when the bale has reached said predetermined location to effect severance of the tie as relative movement between the bale and said tie cutter takes place.

13. A method of severing a tie surrounding a fiber bale having a bottom face and two opposite side faces, comprising the following steps:

(a) advancing the fiber bale in a conveying direction along a travelling path on a supporting surface such that the bottom face of the bale is supported on the supporting surface and the side faces extend substantially perpendicularly to the supporting surface and parallel to the conveying direction;

(b) positioning an optical barrier at a predetermined position along said travelling path;

(c) causing the optical barrier to emit a signal upon passage of said bale at said predetermined position;

(d) moving a tie cutter transversely to said conveying direction from a remote position spaced from the bale toward and into engagement with one of the side faces of the bale;

(e) initiating said moving step when the bale has reached said predetermined position on said travelling path;

(f) holding said tie cutter stationarily;

(g) while performing steps (a) and (f), severing the bale tie by said tie cutter; and (h) returning the tie cutter from said one side face of the bale towards said remote position.

14. The method as defined in claim 13, further comprising the step of pressing the fiber bale by pressing elements against a counterface during performance of step (d).

15. The method as defined in claim 14, wherein said pressing step comprises the step of pressing opposite side faces of said bale; one of said side faces being the bale surface engaged by said tie cutter during step (b).

* * * * *